US006800992B2

(12) United States Patent
Wada et al.

(10) Patent No.: US 6,800,992 B2
(45) Date of Patent: Oct. 5, 2004

(54) IN-LINE TYPE ELECTRON GUN AND COLOR PICTURE TUBE APPARATUS USING THE SAME

(75) Inventors: Yasufumi Wada, Takatsuki (JP); Hiroji Morimoto, Kashihara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 13 days.

(21) Appl. No.: 10/429,021

(22) Filed: May 1, 2003

(65) Prior Publication Data

US 2003/0210001 A1 Nov. 13, 2003

(30) Foreign Application Priority Data

May 9, 2002 (JP) ..... 2002-134206

(51) Int. Cl.[7] ..... H01J 29/50; H01J 29/52

(52) U.S. Cl. ..... 313/414; 313/409; 313/412; 315/381; 315/382

(58) Field of Search ..... 315/381, 382, 315/382.1, 383, 368.16, 5.28; 313/414, 409, 412, 415, 441, 444

(56) References Cited

U.S. PATENT DOCUMENTS 6,133,684 A 10/2000 Kawaharada ..... 313/414

6,452,320 B1 * 9/2002 New ..... 313/414

FOREIGN PATENT DOCUMENTS

| | | |
|---|---|---|
| EP | 0 971 385 | 1/2000 |
| JP | 4-133247 | 5/1992 |
| WO | WO 01/11654 | 2/2001 |

* cited by examiner

*Primary Examiner*—Tuyet Thi Vo
(74) *Attorney, Agent, or Firm*—Merchant & Gould P.C.

(57) ABSTRACT

A focusing electrode and a final accelerating electrode accommodate, respectively, a first and a second field forming electrode in positions set back from a first and a second aperture of their end faces opposed to each other. The first and the second field forming electrode have three electron beam passage apertures disposed in an in-line arrangement. When the in-line direction is an X-axis direction, a direction perpendicular to the in-line direction is a Y-axis direction and the center of a central electron beam passage aperture formed in the first field forming electrode is X=0 and Y=0, the central electron beam passage aperture has a shape that passes through the intersection points of the X-axis and the Y-axis with a curve represented by the equation $(X/R1)^2+(Y/R2)^2=1$ (where R1 and R2 are constants) and that has an area smaller than the area encircled by the curve.

6 Claims, 6 Drawing Sheets

IN-LINE TYPE ELECTRON GUN AND COLOR PICTURE TUBE APPARATUS USING THE SAME

BACKGROUND OF THE INVENTION

1. Field of the Invention

The present invention relates to in-line type electron guns and color picture tube apparatuses using the same. More particularly, the invention relates to a color picture tube apparatus used in television receivers, computer displays and the like, and an in-line type electron gun used therefor provided with a focusing electrode and a final accelerating electrode that form a main lens.

2. Description of the Related Art

In order to obtain a high-resolution image on the phosphor screen of a color picture tube apparatus, it is necessary to decrease the spot diameters on the phosphor screen of three electron beams corresponding respectively to the colors R (red), G (green) and B (blue) emitted from an electron gun, to make the shapes of the spots be a perfect circle, and to simultaneously achieve a just focus of the three electron beams at a common focus voltage on the phosphor screen. In addition, at the time of assembling the electron gun, it is necessary to perform precise positioning of three electron beam passage apertures formed in each of the electrodes of the electron gun.

As a conventional electron gun, the electron gun disclosed in Japanese Patent No. 3056515 is known, for example. In the electron gun disclosed in this patent, a focusing electrode and a final accelerating electrode that form a main lens are disposed at a predetermined gap. A single oval-shaped aperture having a major axis in the horizontal direction is provided on the focusing electrode on its end face opposed to the final accelerating electrode. A field forming electrode composed metal plate is provided on the focusing electrode in a position set back from the aperture, and three electron beam passage apertures disposed in an in-line arrangement in the horizontal direction are formed in the field forming electrode. A single oval-shaped aperture having a major axis in the horizontal direction also is provided on the final accelerating electrode, on its end face opposed to the focusing electrode. A field forming electrode is provided also on the final accelerating electrode in a position set back from the aperture, and three electron beam passage apertures disposed in an in-line arrangement in the horizontal direction are formed in the field forming electrode.

The three electron beam passage apertures formed in the field forming electrode of the conventional electron gun have the following shape. That is, as shown in FIG. 11, a central electron beam passage aperture 101*b* is formed in an oval or ellipse shape having a major axis in the vertical direction. The outer halves of electron beam passage apertures 101*a* and 101*c* provided on both sides of the electron beam passage aperture 101*b* (the electron beam passage aperture 101*c* on the right side is not shown) are each formed in the shape of a semicircle. When the in-line direction is an X-axis direction, the direction perpendicular to the in-line direction is a Y-axis direction and the center of the electron beam passage apertures 101*a* and 101*c* is X=0 and Y=0, the inner halves of the electron beam passage apertures 101*a* and 101*c* are each formed in a shape encircled by a curve represented by the equation $X^n+Y^n=R^n$ (where R is a constant), and n is more than 2.0 and not more than 3.0. Additionally, in FIG. 11, numeral 100 denotes the field forming electrode. It should be noted that FIG. 11 depicts the outlines of the inner half of the electron beam passage aperture 101*a* when n is 2.0, 2.15, 2.25 and 2.5.

As described above, by disposing the field forming electrode 100, in which the three electron beam passage apertures 101*a*, 101*b* and 101*c* are formed, away from the end faces of the focusing electrode and the final accelerating electrode, each of the three main lens fields overlaps with the adjacent main lens field. This enlarges the effective lens diameter of the main lens, thereby making it possible to decrease the beam spot diameter on the phosphor screen. Additionally, the upper and lower arcs of the inner halves of the side electron beam passage apertures 101*a* and 101*c* are bulged outward, and optimum focusing conditions can be attained in the horizontal and vertical directions by appropriately selecting the value of n, as with the case where the apertures are vertically elongated. Accordingly, it is possible to make the shapes of the spots of the side electron beams formed on the phosphor screen to be close to a perfect circle. Moreover, as with the case where the shapes of the apertures are a perfect circle, the side electron beam passage apertures 101*a* and 101*c* have a shape in which their diameters in the horizontal direction and those in the vertical direction are equal and the upper and lower arcs of the inner halves thereof are bulged outward, so that conventional regulating pins having a circular cross section can be passed through the side electron beam passage apertures 101*a* and 101*c*. In this case, the side electron beam passage apertures 101*a* and 101*c* are in contact with the regulating pins on the whole area of the arcs of the outer halves and at the central point (the intersection point with the horizontal axis) of the inner halves, making it possible to perform center alignment with high precision.

However, in the above-described conventional electron gun, the field forming electrode in the focusing electrode or in the final accelerating electrode is located in a position set back from the opposing end face of the final accelerating electrode or of the focusing electrode. Accordingly, it is not possible to make a central main lens field and the side main lens fields, among three main lens fields acting respectively on the three electron beams, to have the same intensity. This results in a problem of not being able to simultaneously achieve a just focus of the three electron beams on the phosphor screen.

In addition, there has been a problem that among the beam spots formed on the phosphor screen as a result of focusing and converging the three electron beams, the central beam cannot be formed in the shape of a perfect circle, although the side beams can.

The present invention was achieved in order to solve the above-described problems in the prior art, and it is an object of the present invention to provide an in-line type electron gun that is capable of making a central main lens field and the side main lens fields, among three main lens fields acting respectively on three electron beams, have the same intensity, as well as being capable of making the shape of even the spot of the central electron beam formed on a phosphor screen be close to a perfect circle, even when a field forming electrode in a focusing electrode or in a final accelerating electrode is disposed away from the opposing end face of the final accelerating electrode or of the focusing electrode to increase the effective lens diameter of the main lens. It is another object of the present invention to provide a color picture tube apparatus using the above-described in-line type electron gun.

SUMMARY OF THE INVENTION

In order to solve the above-described problems, a structure of the in-line type electron gun according to the present invention comprises: a focusing electrode and a final accelerating electrode that form a main lens and that are disposed at a predetermined gap. The focusing electrode has a first aperture in an end face thereof on the final accelerating electrode side and houses a first field forming electrode in a position set back from the first aperture. The final accelerating electrode has a second aperture in an end face thereof on the focusing electrode side and houses a second field forming electrode in a position set back from the second aperture.

Each of the first and the second field forming electrode is provided with a central electron beam passage aperture and an aperture or a notch disposed on each side of the central electron beam passage aperture and having a half-arc shaped portion protruding towards the central electron beam passage aperture that are disposed in an in-line arrangement.

When a direction of the in-line is an X-axis direction, a direction perpendicular to the direction of the in-line is a Y-axis direction and the center of the central electron beam passage aperture is X=0 and Y=0, the central electron beam passage aperture of at least one of the focusing electrode and the final accelerating electrode has a shape that passes through intersection points of the X-axis and the Y-axis with a curve represented by an equation $(X/R1)^2+(Y/R2)^2=1$ (where R1 and R2 are constants) and that has an area smaller than an area encircled by the curve.

With this structure of the in-line type electron gun, even when the first field forming electrode in the focusing electrode or the second field forming electrode in the final accelerating electrode is disposed away from the opposing end face of the final accelerating electrode or of the focusing electrode to increase the effective lens diameter of the main lens, it is possible to make a central main lens field and the side main lens fields, among three main lens fields acting respectively on three electron beams, have the same intensity. This simultaneously achieves a just focus of the three electron beams on the phosphor screen. Moreover, it is possible to make the shape of the spot of the central electron beam, as well as the shapes of the spots of the side electron beams, each formed on the phosphor screen, be close to a perfect circle.

In the above-described structure of the in-line type electron gun of the present invention, it is preferable that the central electron beam passage aperture has a shape encircled by a curve represented by an equation $(X/R1)^n+(X/R2)^n=1$, where n is more than 1.5 and less than 2.0. According to this preferable example, it is possible to decrease the difference in intensity between a central main lens field and the side main lens fields, among three main lens fields acting respectively on the three electron beams, by optimizing the value of n in the range of $1.5<n<2.0$. Consequently, it is possible to achieve simultaneously a just focus of the three electron beams on the phosphor screen, even when a single focus voltage common to the three electron beams is applied to the focusing electrode and the final accelerating electrode. Furthermore, the use of this structure makes it possible to make the shape of the spot of the central electron beam formed on the phosphor screen be close to a perfect circle. In this case, it is preferable that n=about 1.90 to about 1.95.

In the above-described structure of the in-line type electron gun of the present invention, it is preferable that a relationship $R1<R2$ is satisfied. According to this preferable example, it is possible to readily make the lens effects in the horizontal and vertical directions equal by canceling the main lens field in which the lens effect in the horizontal direction is weaker than that in the vertical direction by the main lens field in which the lens effect in the horizontal direction is stronger than that in the vertical direction, thereby making the shape of the spot of the central beam formed on the phosphor screen be a perfect circle.

In the above-described structure of the in-line type electron gun of the present invention, it is preferable that a cylindrical intermediate electrode is further provided between the focusing electrode and the final accelerating electrode. According to this preferable example, it is possible to expand the main lens field in the axis direction of the electron gun by adjusting the electric potential of the intermediate electrode to an arbitrary electric potential between the electric potentials of the focusing electrode and the final accelerating electrode, thereby further increasing the effective lens diameter of the main lens. Consequently, it is possible to further decrease the beam spot diameter on the phosphor screen, achieving an even higher resolution of a color picture tube apparatus.

A structure of the color picture tube apparatus of the present invention comprises:

a bulb comprising a face panel having a phosphor screen including phosphors of a plurality of colors on an inner surface thereof and a funnel connected to a rear portion of the face panel;

an electron gun housed in a neck portion of the funnel;

a shadow mask having a plurality of electron beam passage apertures for passing an electron beam emitted from the electron gun and being disposed in a predetermined position in the bulb with a predetermined gap kept from the phosphor screen; and a deflection yoke mounted at a circumference of the funnel on the neck portion side, wherein the above-described in-line type electron gun of the present invention is used as the electron gun.

This structure of the color picture tube apparatus uses the above-described in-line type electron gun of the present invention as the in-line type electron gun, so that it is possible to decrease the spot diameters of three electron beams corresponding respectively to the colors R (red), G (green) and B (blue) emitted from the electron gun, on the phosphor screen, while making the shapes of the spots be a perfect circle, and to simultaneously achieve a just focus of the three electron beams at a common focus voltage on the phosphor screen. This makes it possible to obtain a color picture tube of a high resolution.

DESCRIPTION OF THE PREFERRED EMBODIMENTS

Hereinafter, the present invention will be described more specifically by way of embodiments.

Figure 1:
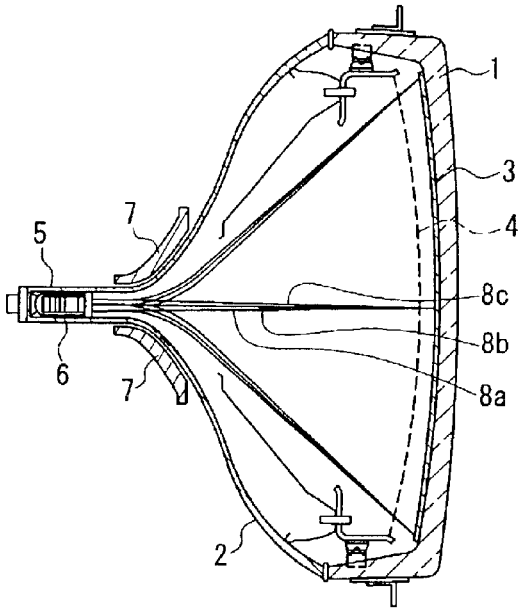
FIG. 1 is a horizontal cross-sectional view showing a color picture tube apparatus according to one embodiment of the present invention.
Figure 2:
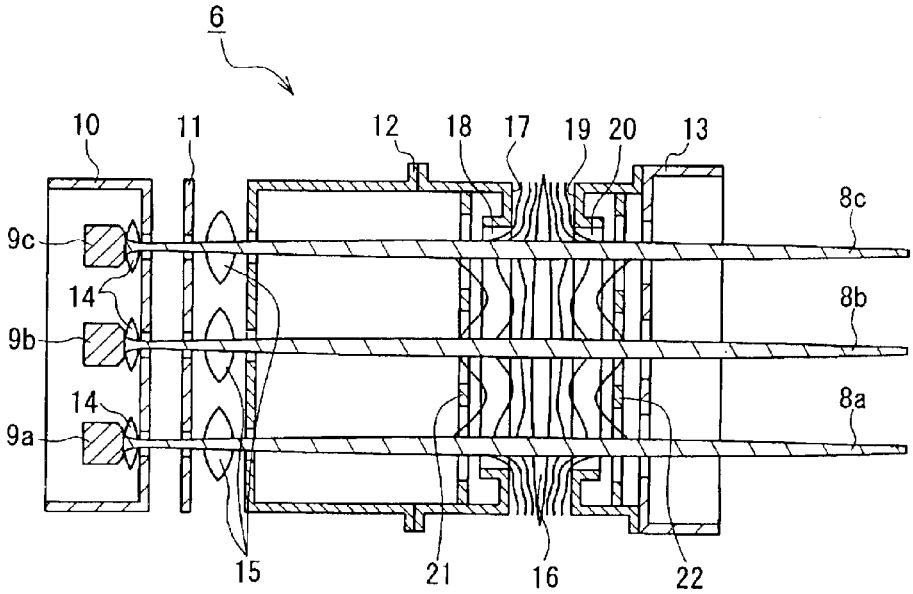
FIG. 2 is a horizontal cross-sectional view showing an in-line type electron gun according to one embodiment of the present invention.

FIG. 1 is a horizontal cross-sectional view showing a color picture tube apparatus according to one embodiment of the present invention. FIG. 2 is a horizontal cross-sectional view showing an in-line type electron gun according to one embodiment of the present invention.

As shown in FIG. 1, the color picture tube apparatus of this embodiment is provided with a bulb including a face panel 1 made of a glass or the like and a funnel 2 that is connected to a rear portion of the face panel 1 and is also made of a glass or the like. A phosphor screen 3 made of three colors of phosphors that emit red, green and blue, respectively, is formed on the inner surface of the face panel 1. A neck portion 5 of the funnel 2 houses an electron gun 6. A shadow mask 4 for regulating the position that electron beams emitted from the electron gun 6 reach is disposed in a predetermined position in the above-described bulb, with a predetermined gap kept from the phosphor screen 3 on the inner surface of the face panel 1. Here, the shadow mask 4 serves to screen the colors of three electron beams 8*a*, 8*b* and 8*c* corresponding respectively to the colors R (red), G (green) and B (blue) emitted from the electron beam 6, and is configured by forming, on a flat plate, a large number of substantially slot-like apertures serving as electron beam passage apertures by etching. In addition, a deflection yoke 7 for deflecting the electron beams 8*a*, 8*b* and 8*c* emitted from the electron gun 6 in the vertical and horizontal directions is mounted at a circumference of the funnel 3 on the neck portion 5 side.

As shown in FIG. 2, the electron gun 6 includes in succession three cathodes 9*a*, 9*b* and 9*c* disposed in an in-line arrangement in the horizontal direction, a cup-like control grid electrode 10 housing the cathodes 9*a*, 9*b* and 9*c*, a plate-like accelerating electrode 11, a focusing electrode 12 and a final accelerating electrode 13.

Three apertures are formed in the control grid electrode 10 at positions opposing the three cathodes 9*a*, 9*b* and 9*c*. Similarly, three apertures substantially coaxial with the respective three apertures formed in the control grid electrode 10 are formed in the accelerating electrode 11 and the focusing electrode 12 on its end face opposed to the accelerating electrode 11. Thermoelectrons generated by the cathodes 9*a*, 9*b* and 9*c* are formed into beams by cathode lenses 14 made up of the cathodes 9*a*, 9*b* and 9*c*, the control grid electrode 10 and the accelerating electrode 11, and are taken out as the electron beams 8*a*, 8*b* and 8*c*. The electron beams 8*a*, 8*b* and 8*c* are focused on the phosphor screen 3 by pre-focus lenses 15 made up of the accelerating electrode 11 and the focusing electrode 12 and a main lens 16 made up of the focusing electrode 12 and the final accelerating electrode 13.

In the electron gun 6 of this embodiment, the focusing electrode 12 and the final accelerating electrode 13 are configured as follows, in order to increase the effective lens diameter of the main lens 16 and to decrease beam spot diameters on the phosphor screen 3. An end face 17 of the focusing electrode 12 that is opposed to the final accelerating electrode 13 is provided with a single oval-shaped aperture 18 having a major axis in the horizontal direction, with its edges bent inward. The focusing electrode 12 houses a field forming electrode 21 in a position set back from the aperture 18. Similarly, an end face 19 of the final accelerating electrode 13 that is opposed to the focusing electrode 12 is provided with a single oval-shaped aperture 20 having a major axis in the horizontal direction, with its edges bent inward. The final accelerating electrode 13 houses a field forming electrode 22 in a position set back from the aperture 20. Here, the field forming electrodes 21 and 22 are made of discrete members from the focusing electrode 12 and the final accelerating electrode 13, and are fixed to the focusing electrode 12 and the final accelerating electrode 13, respectively, by welding or the like.

Furthermore, in the electron gun 6 of this embodiment, three electron beam passage apertures associated respectively with the three electron beams 8*a*, 8*b* and 8*c* are formed in each of the field forming electrodes 21 and 22. In particular, the electron beam passage apertures formed in the field forming electrode 21 of the focusing electrode 12 have a structure as described below.

Figure 3:
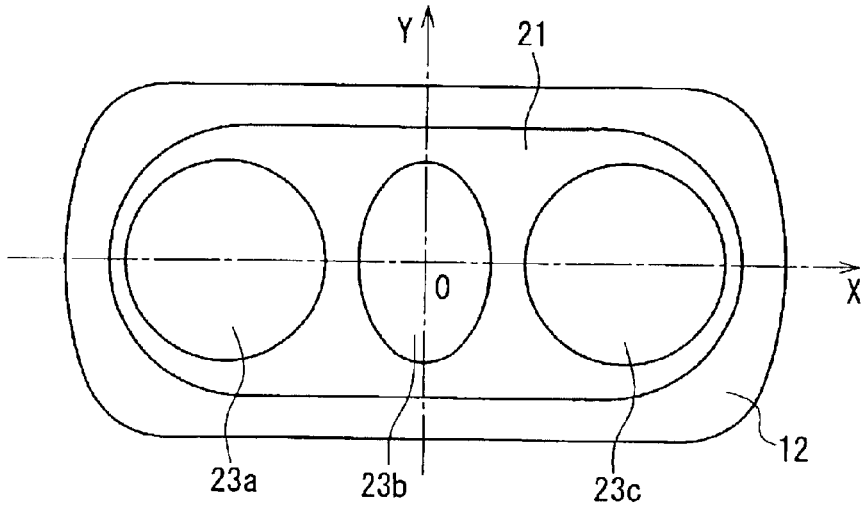
FIG. 3 is a front view showing a focusing electrode of an in-line type electron gun according to one embodiment of the present invention.
Figure 4:
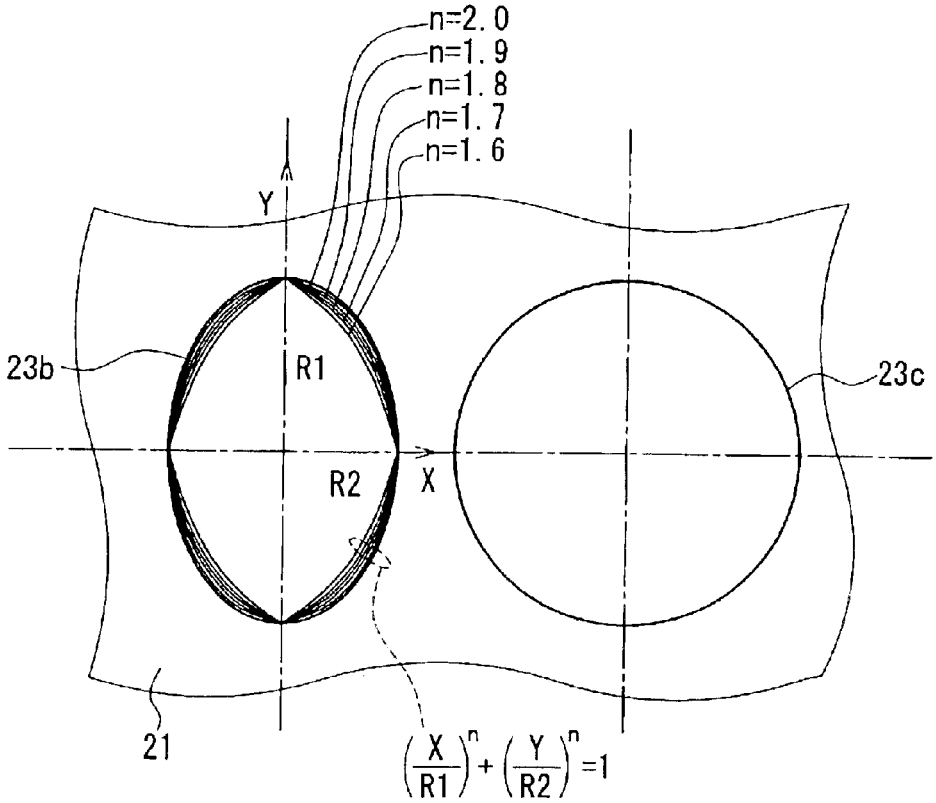
FIG. 4 is a front view showing a relevant part of a field forming electrode of an in-line type electron gun according to one embodiment of the present invention.

FIG. 3 is a front view showing a focusing electrode of an in-line type electron gun according to one embodiment of the present invention. As shown in FIG. 3, three electron beam passage apertures 23*a*, 23*b* and 23*c* disposed in an in-line arrangement in the horizontal direction are formed in the field forming electrode 21 of the focusing electrode 21. The central electron beam passage aperture 23*b* formed in the field forming electrode 21 has the following shape. That is, when the in-line direction is an X-axis direction, a direction perpendicular to the in-line direction is a Y-axis direction and the center of the electron beam passage aperture 23*b* is X=0 and Y=0, the central electron beam passage aperture 23*b* has a shape that passes through the intersection points of the X-axis and the Y-axis with a curve represented by the equation $(X/R1)^2+(Y/R2)^2=1$ (where R1 and R2 are constants) and that has an area smaller than the area encircled by the above-described curve. Here, R1 represents a length of one-half the major axis of the ellipse, and R2 represents a length of one-half the minor axis of the ellipse. The curve connecting the four intersection points of the X-axis and the Y-axis with the reference elliptical plane $(X/R1)^2+(Y/R2)^2=1$ in the central electron beam passage aperture 23*b* has a shape protruding outward and being smooth in each of the first to fourth quadrants. More specifically, as shown in FIG. 4, it is desirable that the central electron beam passage aperture 23*b* formed in the field forming electrode 21 has a shape encircled by a curve represented by the equation $(X/R1)^n+(Y/R2)^n=1$ (where R1 and R2 are constants), and n is more than 1.5 and less than 2.0. Additionally, for the reason described below, it is desirable that the central electron beam passage aperture 23*b* satisfies the relation R1<R2 in the above-mentioned equation. FIG. 4 depicts outlines of the electron beam passage aperture 23*b* when n is 1.6, 1.7, 1.8, 1.9 and 2.0. In this case, when n is decreased from 2.0 to 1.5, the shape of the central electron beam passage aperture 23*b* changes from an ellipse to a diamond. It should be noted that the central electron beam passage aperture formed in the field forming electrode 22 of the final accelerating electrode 13 may have a shape as described above, or both of the central electron beam passage apertures formed in the field forming electrodes 21 and 22 may have a shape as described above.

As shown in FIGS. 3 and 4, the halves on at least the side of the central electron beam passage aperture 23*b* of the electron beam passage apertures 23*a* and 23*c* disposed on both sides of the electron beam passage aperture 23*b* have a semicircular shape. That is, the side electron beam passage apertures 23*a* and 23*c* have a half-arc shaped portion protruding toward the central electron beam passage aperture 23*b*. In this embodiment, the side electron beam passage apertures 23*a* and 23*c* are formed in the shape of a perfect circle. By forming the side electron beam passage apertures 23*a* and 23*c* to have a half-arc shaped portion protruding towards the central electron beam passage aperture 23*b* in this manner, conventional regulating pins having a circular cross section can be passed through the side electron beam passage apertures 23*a* and 23*c*. In this case, the side electron beam passage apertures 23*a* and 23*c* are in contact with the regulating pins on the whole area of the arcs of the inner halves and at the central point (the intersection point with the horizontal axis) of the outer halves, making it possible to perform center alignment with high precision. The foregoing also applies to the side electron beam passage apertures formed in the field forming electrode 22 of the final accelerating electrode 13.

By forming at least one of the central electron beam passage apertures formed in the field forming electrodes 21 and 22 in a shape that passes through the intersection points of the X-axis and the Y-axis with a curve represented by the equation $(X/R1)^2+(Y/R2)^2=1$ (where R1 and R2 are constants) and that has an area smaller than the area encircled by the above-described curve, and by forming both of the side electron beam passage apertures formed in the field forming electrode 21 and those formed in the field forming electrode 22 to have the above-described structure, the following effect can be achieved. Even when the field forming electrode 21 in the focusing electrode 12 or the field forming electrode 22 in the final accelerating electrode 13 is disposed away from the end face 17 of the focusing electrode 12 or the end face 19 of the final accelerating electrode 13 to increase the effective lens diameter of the main lens 16, it is possible to make a central main lens field and the side main lens fields, among three main lens fields acting respectively on the three electron beams 8*a*, 8*b* and 8*c*, have the same intensity, thereby simultaneously achieving a just focus of the three electron beams 8*a*, 8*b* and 8*c* on the phosphor screen 3. Moreover, it is possible to make the shape of the spot of the central electron beam 8*b*, as well as the shapes of the spots of the side electron beams 8*a* and 8*c*, each formed on the phosphor screen 3, be close to a perfect circle.

In the following, this will be described by taking as an example a case where at least one of the central electron beam passage apertures formed in the field forming electrodes 21 and 22 has a shape encircled by a curve represented by the equation $(X/R1)^n+(Y/R2)^n=1$ (where R1 and R2 are constants).

In this case, by optimizing the value of n in the range of $1.5<n<2.0$, it is possible to decrease the difference in intensity between the central main lens field and the side main lens fields, among the three main lens fields acting respectively on the three electron beams 8*a*, 8*b* and 8*c*. Consequently, it is possible to simultaneously achieve a just focus of the three electron beams 8*a*, 8*b* and 8*c* on the phosphor screen 3, even when a focus voltage common to the three electron beams 8*a*, 8*b* and 8*c* is applied to the focusing electrode 12 and the final accelerating electrode 13. Moreover, with this structure, it is also possible to make the shape of the spot of the central electron beam 8*b* formed on the phosphor screen 3 be close to a perfect circle. In the following, the electron beam focusing properties will be described in detail in the case where n is varied.

Figure 5:
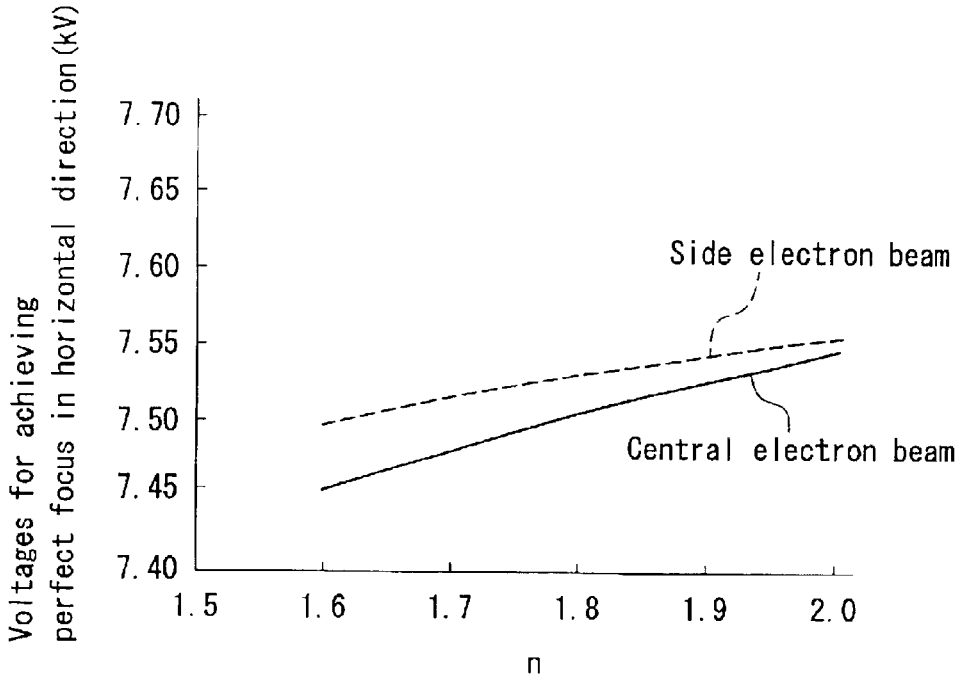
FIG. 5 is a graph obtained by plotting the voltages for achieving a just focus in the horizontal direction of a central electron beam and the side electron beams with respect to n in the equation $(X/R1)^n+(Y/R2)^n=1$ representing the shape of a central electron beam passage aperture formed in a field forming electrode according to one embodiment of the present invention.
Figure 6:
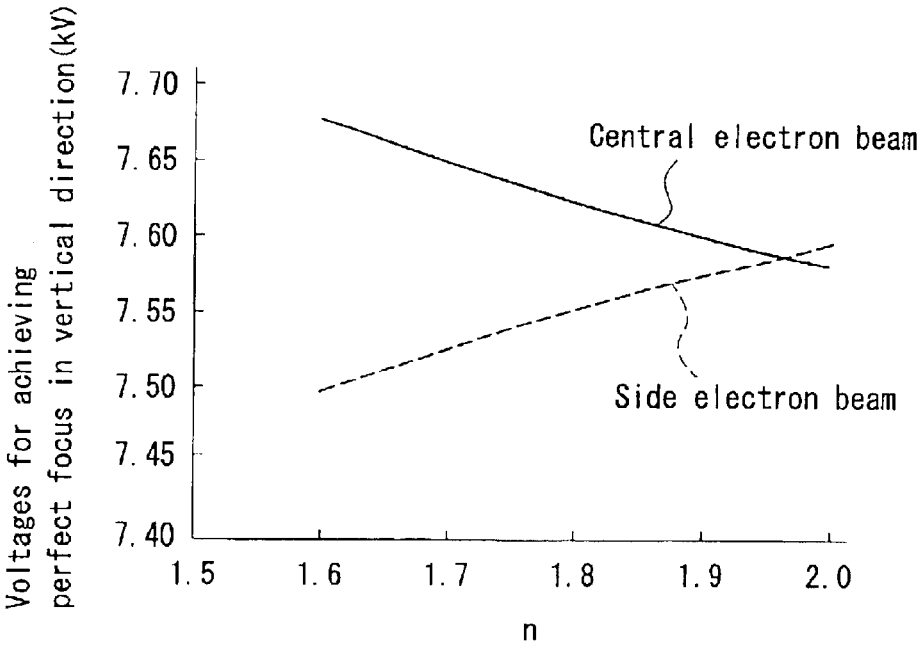
FIG. 6 is a graph obtained by plotting the voltages for achieving a just focus in the vertical direction of a central electron beam and the side electron beams with respect to n in the equation $(X/R1)^n+(Y/R2)^n=1$ representing the shape of a central electron beam passage aperture formed in a field forming electrode according to one embodiment of the present invention.

FIG. 5 is a graph obtained by determining, by an orbital calculation of a three-dimensional electric field, the focus voltage applied to the focusing electrode 12 that is required to achieve a just focus of the central electron beam 8*b* and the side electron beams 8*a* and 8*c* in the horizontal direction and plotting the same, in order to evaluate the properties of the main lens field of focusing the electron beams when n is varied in the above-described equation. Similarly, FIG. 6 is a graph obtained by determining, by an orbital calculation of a three-dimensional electric field, the focus voltage applied to the focusing electrode 12 that is required to achieve a just focus of the central electron beam 8*b* and the side electron beams 8*a* and 8*c* in the vertical direction and plotting the same, in order to evaluate the properties of the main lens field of focusing the electron beams when n is varied in the, above-described equation. As can be seen from FIGS. 5 and 6, the amounts of change of the voltages for achieving a just focus with respect to n are different between the central electron beam 8*b* and the side electron beams 8*a* and 8*c*, both in the horizontal and vertical directions. In this case, in view of the fact that a variation of about 50 V between the central electron beam 8*b* and the side electron beams 8*a* and 8*c* does not affect the focusing properties, FIGS. 5 and 6 demonstrate that the intensity of the main lens field exerted on the central electron beam 8*b* by the main lens 16 and the intensity of the main lens field exerted on the side electron beams 8*a* and 8*c* by the main lens 16 can be made uniform by setting n=about 1.90 to about 1.95.

It should be noted that the above-described focusing properties were evaluated when the distance between the focusing electrode 12 and the final accelerating electrode 13 was 1.0 mm, the distance between the end face 17 of the focusing electrode 12 and the field forming electrode 21 and between the end face 19 of the final accelerating electrode 13 and the field forming electrode 22 was 3.5 mm, the vertical length of the field forming electrodes 21 and 22 was 11.8 mm, the horizontal length thereof was 21.3 mm, the central electron beam passage aperture was an elliptical aperture having a major axis 2×R1 of 4.24 mm and a minor axis 2×R2 of 5.66 mm, and the side electron beam passage apertures were circular apertures each having a diameter of 6.54 mm. In addition, the voltage applied to the final accelerating electrode 13 was 27 kV.

The intensity of the main lens field exerted on the central electron beam 8*b* by the main lens 16 and the intensity of the main lens field exerted on the side electron beams 8*a* and 8*c* by the main lens 16 can be made uniform as described above for the following reason.

As in the case of this embodiment, in order to correct a main lens field generated by an oval-shaped aperture having a major axis in the horizontal direction (the in-line direction) formed in each of the opposing end faces of a focusing electrode and a final accelerating electrode, the electron beam passage apertures of field forming electrodes are generally formed in a shape having a major axis in the vertical direction, which is a direction opposite from the direction of the major axis of the aperture. In this case, when the shape of the central electron beam passage aperture 23*b* is changed from an ellipse to a diamond as in this embodiment, the aperture is more reduced in the vertical direction than in the horizontal direction. Accordingly, the penetration of the main lens field into the central electron beam 8*b* is weakened in the vertical direction, so that the lens effect on the central electron beam 8*b* is strengthened in the vertical direction (or the lens effect on the central electron beam 8*b* is weakened in the horizontal direction). Therefore, in order to achieve a just focus of the central electron beam 8*b* on the phosphor screen 3, it is necessary to raise the focus voltage in the vertical direction to weaken the strengthened lens effect in the vertical direction, and to lower the focus voltage in the horizontal direction to strengthen the weakened lens effect in the horizontal direction. On the other hand, the penetration of the main lens field into the side electron beams 8*a* and 8*c* is strengthened both in the horizontal and vertical directions by changing the shape of the central electron beam passage aperture 23*b* from an ellipse to a diamond, so that the lens effect on the side electron beams 8*a* and 8*c* is weakened both in the horizontal and vertical directions. Therefore, in order to simultaneously achieve a just focus of the three electron beams 8*a*, 8*b* and 8*c* on the phosphor screen 3, it is necessary to lower the focus voltage both in the horizontal and vertical directions to strengthen the weakened lens effect in the horizontal and vertical directions. In this case, the change in shape of the central electron beam passage aperture 23*b* is greater in the vertical direction than in the horizontal direction, so that the change in focus voltage is greater in the vertical direction than in the horizontal direction.

As described above, by changing the shape of the central electron beam passage aperture 23*b* of the field forming electrode from an ellipse to a diamond, it is possible to change the intensity of the main lens field exerted on the central electron beam 8*b* by the main lens 16 and the intensity of the main lens field exerted on the side electron beams 8*a* and 8*c* by the main lens 16, enabling a design in which the two intensities of the main lens field are made uniform.

Figure 7:
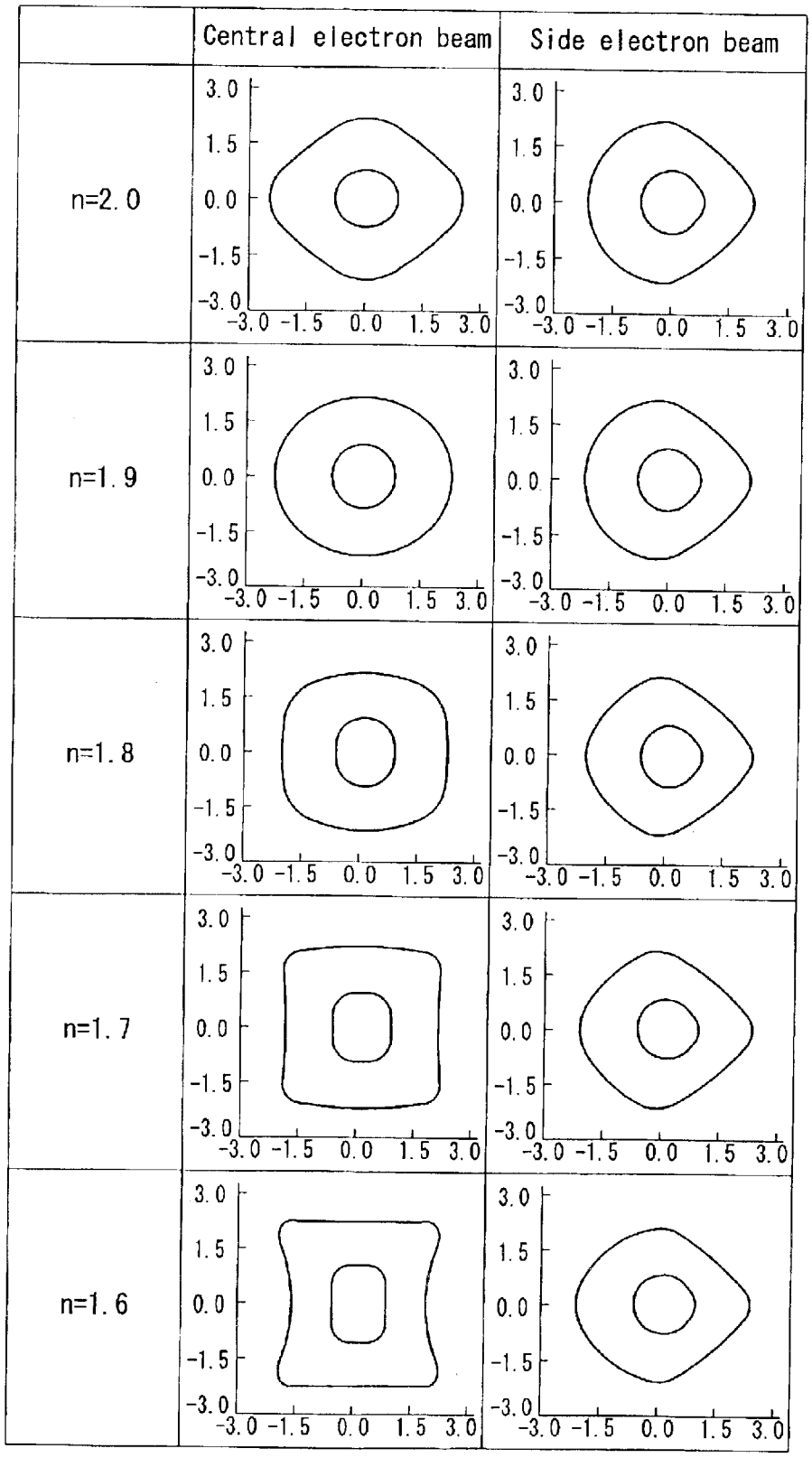
FIG. 7 is a diagram showing the shapes of the spots of a central electron beam and the side electron beams with respect to n in the equation $(X/R1)^n+(Y/R2)^n=1$ representing the shape of a central electron beam passage aperture formed in a field forming electrode according to one embodiment of the present invention.

FIG. 7 is a diagram obtained by rotating, at a constant radius, the orbit of the electron beam incident on the main lens 16 with the axis of the main lens as the center, when the central electron beam passage apertures 23*b* of the field forming electrodes of the focusing electrode 12 and the final accelerating electrode 13 have a shape encircled by a curve represented by the equation $(X/R1)^n+(Y/R2)^n=1$ (where R1 and R2 are constants), calculating the paths of the resulting orbits on the phosphor screen 3 and plotting the same. In FIG. 7, the circular path indicates that the actual electron beam forms a circular spot on phosphor screen 3. In addition, the inner path in FIG. 7 denotes the path of the electron beam that passed through the region in a radius of 0.5 mm of the main lens 16, whereas the outer path denotes the path of the electron beam that passed through the region in a radius of 1.0 mm of the main lens 16. As shown in FIG. 7, when n is decreased from 2.0 to 1.6, the path of the central electron beam 8*b* is changed from a diamond to a perfect circle and eventually becomes a rectangle, whereas the paths of the side electron beams 8*a* and 8*c* hardly are changed by the change in n. Thus, by changing the value of n, it is possible to adjust only the path of the central electron beam 8*b*, without affecting the paths of the side electron beams 8*a* and 8*c*.

As described above, it is desirable that the central electron beam passage aperture 23*b*, among the three electron beam passage apertures disposed in an in-line arrangement on the field forming electrode, satisfies the relation R1<R2 in the above equation $(X/R1)^n+(Y/R2)^n=1$ (where R1 and R2 are constants) (see, FIGS. 3 and 4). That is, it is desirable that the opening width of the central electron beam passage aperture 23*b* in the in-line direction (the X-axis direction) is smaller than that in the Y-axis direction. The reason is that the use of this structure makes it possible to readily make the lens effects in the horizontal and vertical directions equal by canceling the main lens field in which the lens effect in the horizontal direction is weaker than that in the vertical direction by the main lens field in which the lens effect in the horizontal direction is stronger than that in the vertical direction, thereby making the shape of the spot of the central electron beam 8*b* formed on the phosphor screen 3 be a perfect circle.

It should be noted that although the three cathodes 9*a*, 9*b* and 9*c* are disposed in an in-line arrangement in the horizontal direction in the above-described embodiment, the three cathodes 9*a*, 9*b* and 9*c* may be disposed in an in-line arrangement in the vertical direction, in which case "horizontal direction" and "vertical direction" should be interchanged in the above-described embodiment.

Figure 8:
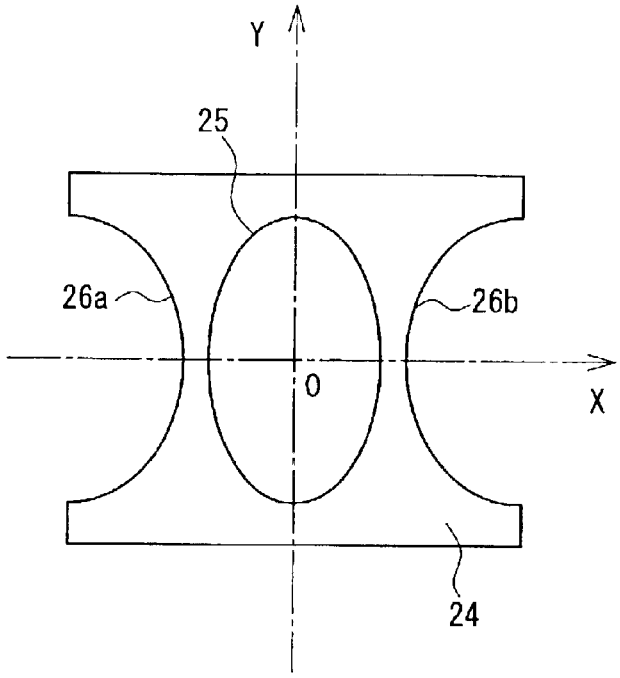
FIG. 8 is a front view showing another example of a field forming electrode of an in-line type electron gun according to one embodiment of the present invention.

In addition, although the three electron beam passage apertures associated with the three electron beams 8*a*, 8*b* and 8*c* are formed in each of the field forming electrodes 21 and 22 in the above-described embodiment, the present invention is not necessarily limited to this structure. For example, as shown in FIG. 8, a central electron beam passage aperture 25 may be formed in the center of a field forming electrode 24, while providing both ends of the field forming electrode 24 with notches 26*a* and 26*b*, each having a half-arc shaped portion, protruding towards the central electron beam passage aperture 25. In this case, the two side electron beams 8*a* and 8*c* pass through the region surrounded by the half-arc shaped portions of the notches 26*a* or 26*b* and the focusing electrode 12 or the final accelerating electrode 13.

Figure 9:
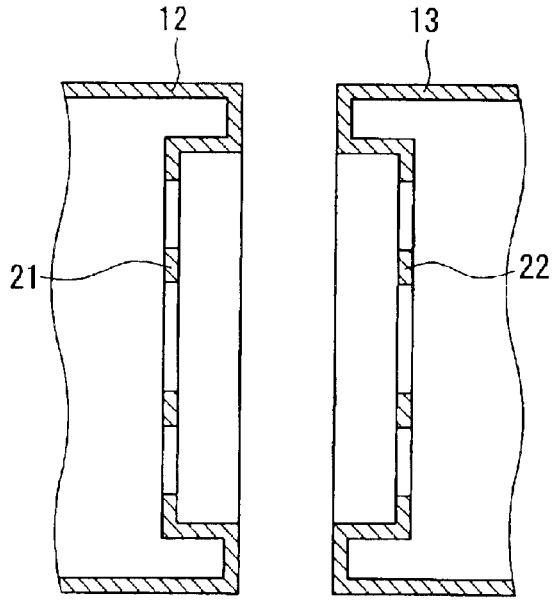
FIG. 9 is a horizontal cross-sectional view showing another structure of a focusing electrode and a final accelerating electrode of an in-line type electron gun according to one embodiment of the present invention.

Although discrete members from the focusing electrode 12 and the final accelerating electrode 13 are used as the field forming electrodes 21 and 22 in the above-described embodiment, the present invention is not necessarily limited to this structure. For example, as shown in FIG. 9, the focusing electrode 12 and the field forming electrode 21 may be integrated into one piece by pressing. Or, similarly, the final accelerating electrode 13 and the field forming electrode 22 may be integrated into one piece by pressing.

Figure 10:
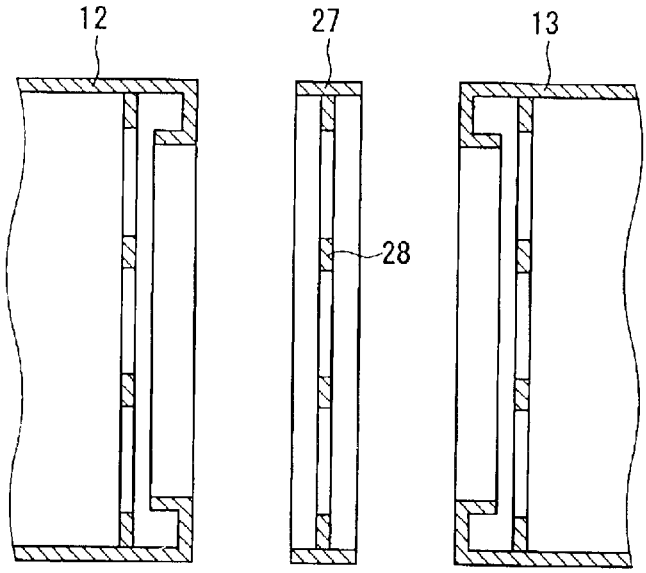
FIG. 10 is a horizontal cross-sectional view showing another structure of a main lens portion of an in-line type electron gun according to one embodiment of the present invention.
Figure 11:
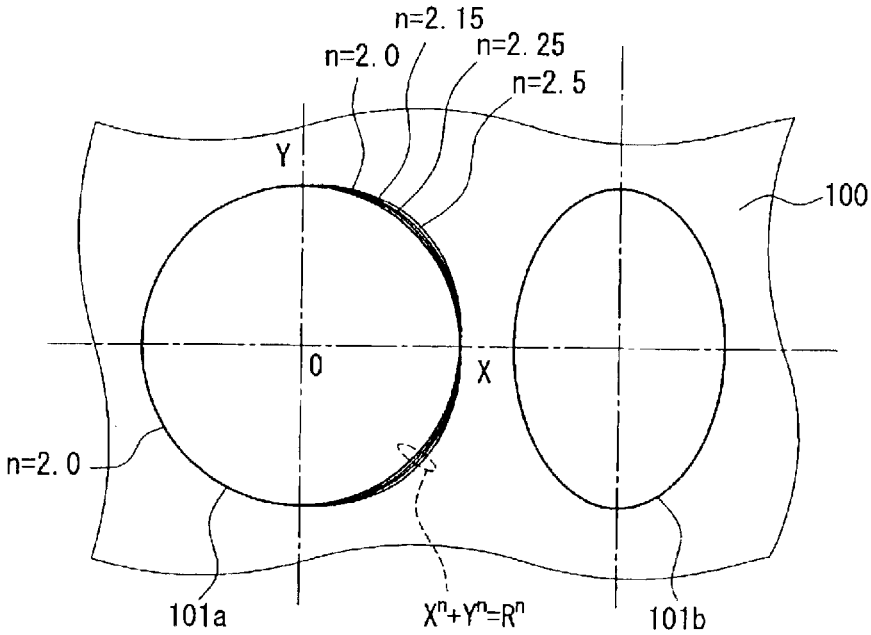
FIG. 11 PRIOR ART
FIG. 11 is a front view showing a relevant part of a field forming electrode of an electron gun in the prior art.

Although the focusing electrode 12 and the final accelerating electrode 13 are disposed opposite to each other without any other member interposed therebetween in the above-described embodiment, the present invention is not necessarily limited to this structure. For example, as shown in FIG. 10, a cylindrical intermediate electrode 27 may be disposed between the focusing electrode 12 and the final accelerating electrode 13. The use of this structure makes it possible to expand the main lens field in the axis direction of the electron gun by adjusting the electric potential of the intermediate electrode 27 to an arbitrary electric potential between the electric potentials of the focusing electrode 12 and the final accelerating electrode 13 (electric potential of focusing electrode <electric potential of intermediate electrode <electric potential of final accelerating electrode), thereby further increasing the effective lens diameter of the main lens. Consequently, it is possible to further decrease the beam spot diameter on the phosphor screen 3, achieving an even higher resolution of a color picture tube apparatus. In this case, the intermediate electrode 27 may house a field forming electrode 28. It is to be noted here that the number of intermediate electrodes to be disposed is not limited to one, and a plurality of intermediate electrodes may be disposed.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An in-line type electron gun comprising:

a focusing electrode and a final accelerating electrode that form a main lens and that are disposed at a predetermined gap, the focusing electrode having a first aperture in an end face thereof on the final accelerating electrode side and housing a first field forming electrode in a position set back from the first aperture, the final accelerating electrode having a second aperture in an end face thereof on the focusing electrode side and housing a second field forming electrode in a position set back from the second aperture, wherein each of the first and the second field forming electrode is provided with a central electron beam passage aperture and an aperture or a notch being disposed on each side of the central electron beam passage aperture and having an half-arc shaped portion protruding towards the central electron beam passage aperture that are disposed in an in-line arrangement, and, when a direction of the in-line is an X-axis direction, a direction perpendicular to the direction of the in-line is a Y-axis direction and the center of the central electron beam passage aperture is X=0 and Y=0, the central electron beam passage aperture of at least one of the focusing electrode and the final accelerating electrode has a shape that passes through intersection points of the X-axis and the Y-axis with a curve represented by an equation $(X/R1)^2+(Y/R)^2=1$ (where R1 and R2 are constants) and that has an area smaller than an area encircled by the curve.

2. The in-line type electron gun according to claim 1, wherein the central electron beam passage aperture has a shape encircled by a curve represented by an equation $(X/R1)^n+(X/R2)^n=1$, where n is more than 1.5 and less than 2.0.

3. The in-line electron gun according to claim 2, wherein n=about 1.90 to about 1.95.

4. The in-line type electron gun according to claim 1, wherein a relationship R1<R2 is satisfied.

5. The in-line type electron gun according to claim 1, further comprising a cylindrical intermediate electrode between the focusing electrode and the final accelerating electrode.

6. A color picture tube apparatus comprising:

a bulb comprising a face panel having a phosphor screen including phosphors of a plurality of colors on an inner surface thereof and a funnel connected to a rear portion of the face panel;

an electron gun housed in a neck portion of the funnel;

a shadow mask having a plurality of electron beam passage apertures for passing an electron beam emitted from the electron gun and being disposed in a predetermined position in the bulb with a predetermined gap kept from the phosphor screen; and a deflection yoke mounted at a circumference of the funnel on the neck portion side, wherein the in-line type electron gun according to claim 1 is used as the electron gun.

* * * * *